343-700 MS AU 251 EX
6/12/84 OR 4,454,514

United States Patent [19]

Itoh et al.

[11] 4,454,514

[45] Jun. 12, 1984

[54] STRIP ANTENNA WITH POLARIZATION CONTROL

[75] Inventors: Kiyohiko Itoh, Sapporo; Yoshihiko Mikuni, Kamakura; Kensei Sugita, Tokyo, all of Japan

[73] Assignee: Tokyo Shibaura Denki Kabushiki Kaisha, Kawasaki, Japan

[21] Appl. No.: 371,927

[22] Filed: Apr. 26, 1982

[30] Foreign Application Priority Data

May 14, 1981 [JP] Japan ..... 56-72591
May 14, 1981 [JP] Japan ..... 56-72592

[51] Int. Cl.[3] ..... H01Q 1/38
[52] U.S. Cl. ..... 343/700 MS; 343/853
[58] Field of Search ..... 343/700 MS, 829, 846, 343/853

[56] References Cited

U.S. PATENT DOCUMENTS 3,921,177 11/1975 Munson .
4,054,874 10/1977 Oltman ..... 343/700 MS
4,191,959 3/1980 Kerr ..... 343/700 MS

FOREIGN PATENT DOCUMENTS 1294024 10/1972 United Kingdom ..... 343/700 MS

*Primary Examiner*—Eli Lieberman
*Attorney, Agent, or Firm*—Oblon, Fisher, Spivak, McClelland & Maier

[57] ABSTRACT

A linear polarization strip antenna which comprises a dielectric substrate whose backside is fitted with a conductive ground film, a power supply strip line which is formed of a conductive film and on the surface of the dielectric substrate, and a linear polarization radiation element. The strip line and radiation element are electromagnetically coupled together. A diode is connected between a top end of the strip line and a ground terminal. The top end of the strip line is selectively set at an open or grounded state according to the conductive state of the diode to vary the mode of electromagnetic coupling between the strip line and radiation element, thereby changing the direction in which the radiated electromagnetic wave is polarized.

10 Claims, 21 Drawing Figures

66
64

66
64

I,V
I
V
X
IV

I,V
V
I
X 60
66
72
64
68
70
74
IV 60
62
66
64

STRIP ANTENNA WITH POLARIZATION CONTROL

BACKGROUND OF THE INVENTION

This invention relates to a strip antenna whose polarization characteristic can be changed.

A polarization antenna is generally demanded to have its polarization characteristic electrically changed. FIG. 1 shows a linearly polarized strip antenna capable of changing the direction of polarization. This strip antenna comprises a dielectric substrate 10 whose backside is fitted with a ground conducting film, power supply circuit 12 including a strip line which is provided on the dielectric substrate 10 and is formed of a dielectric film and a linearly polarized radiator 14 which is formed of a rectangular conductive film. The power supply circuit 12 is arranged as follows. A strip line 16 is divided into two paths by a power divider 18. One path 20 is connected to the center of one side of a radiation element 14. The other path 22 is connected to the anode of a diode 28 and the cathode of a diode 30 through a capacitor 24 and strip line 26. The cathode of the diode 28 is connected to the cathode of a diode 34 through a strip line 32. The anode of the diode 30 is connected to the anode of a diode 38 through a strip line 36. The anode of the diode 34 and the cathode of the diode 38 are connected through a strip line 40 and capacitor 42 to one side of the radiation element 14 which lies adjacent to that side to which the one path 20 is connected. In this case, two paths connecting the radiation element 14 and divider 18 together are chosen to have an equal electric length. The power divider 18 divides the power supplied to the strip line 16 so that the divided power components have the same phase and amplitude. The power running through the strip lines 32 and 36 are arranged to have the same amplitude, but to be displaced 180° from each other in respect of phase. The strip lines 26 and 40 are connected to a bias terminal 48 through the corresponding low path filters 44 and 46. The strip lines 32 and 36 are connected to a ground terminal through the corresponding low path filters 50 and 52. The capacitors 24 and 42 prevent the DC bias conducted to the diodes 28, 30, 34 and 38 from being diverted to any other circuit section. Conversely, the low pass filters 44, 46, 50 and 52 allow for the passage of the DC component, but prevent high frequency current delivered to the strip lines from being conducted to the bias terminal 48 or ground terminal.

The operation of the conventional strip antenna shown in FIG. 1 is now given. Where a positive bias voltage is impressed on the bias terminal 48, then the diodes 34 and 28 are rendered conductive, and the diodes 30 and 38 are rendered nonconductive. At this time, high frequency current components supplied to the radiation element 14 through the two divided paths have the same phase and same amplitude. As shown in FIG. 2A, therefore, current runs in the directions indicated by broken lines. The composite current flows in the direction of the indicated solid line. Where a negative bias voltage is impressed on the bias terminal 48, then the diodes 38 and 30 are rendered conductive, and the diodes 28 and 34 are rendered nonconductive. At this time, the current components delivered to the radiation element 14 through the two divided paths have the opposite phases and same amplitude. In the radiation element 14, therefore, two currents flow in the directions of broken lines shown in FIG. 2B, and the composite current runs in the direction of the indicated solid line. As described above, the direction of the current conducted through the radiation element 14 is displaced 90° in accordance with the polarity of the voltage impressed on the bias terminal 48. As a result, a radiated electromagnetic wave is polarized in a direction displaced 90°.

However, the conventional linearly polarized antenna arranged as described above has the following drawbacks. The current components supplied to the radiation element 14 through the two divided paths are demanded to have the same phase or opposite phases. Since, however, diodes are provided in one of the two divided paths, the phase relationship can not be accurately controlled. Further, it is difficult to let the two divided current components have exactly the same phase in the divider 18. Consequently the direction of polarization is not changed to an extent of accurately 90°, thereby probably leading to a decline in cross polarization discrimination. Further, errors tend to occur in the amplitudes of the two divided current components due to errors in the lengths of the strip lines 32 and 36. With the conventional strip antenna arranged as described above, a large number of elements have to be provided in the power supply circuit, causing the strip antenna to occupy a larger space and increase in cost. Where an array antenna in particular is constructed, an increase in the area occupied by the antenna restricts the location of a radiation element. The above-mentioned drawbacks occurred not only in the linearly polarized antenna, but also in the circularly or elliptically polarized antenna applied to date.

SUMMARY OF THE INVENTION

To attain the above-mentioned object, this invention provides a simple and compact strip antenna capable of accurately changing the polarization direction which comprises a dielectric substrate, a strip line formed of a conductive film mounted on the dielectric substrate, an antenna element formed of a conductive film, set close to the strip line on the dielectric substrate and electromagnetically coupled to the strip line, and a switching section connected to the opposite terminal of the strip line to the power supply terminal thereof, thereby selectively rendering the opposite terminal open or short-circuited.

DETAILED DESCRIPTION OF THE PREFERRED EMBODIMENTS

Figure 1:
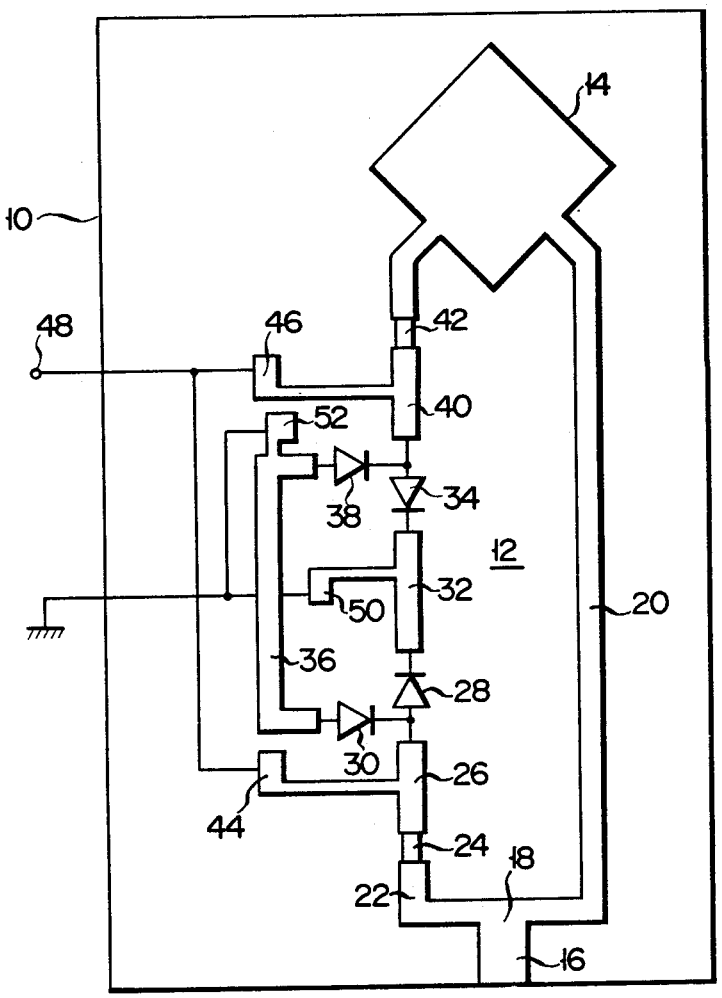
FIG. 1 (PRIOR ART)
FIG. 1 shows the arrangement of the conventional linearly polarized strip antenna.
Figure 2A:
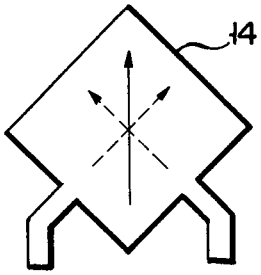
FIG. 2A (PRIOR ART)
FIGS. 2A and 2B show the patterns of polarization occurring on the surface of the radiation element.
Figure 2B:
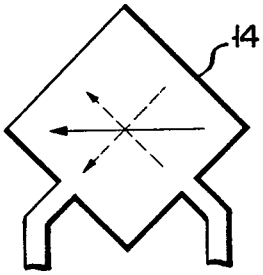
FIG. 2B (PRIOR ART)
Figures 3, 4, 5A, 5B, 6A, 6B:
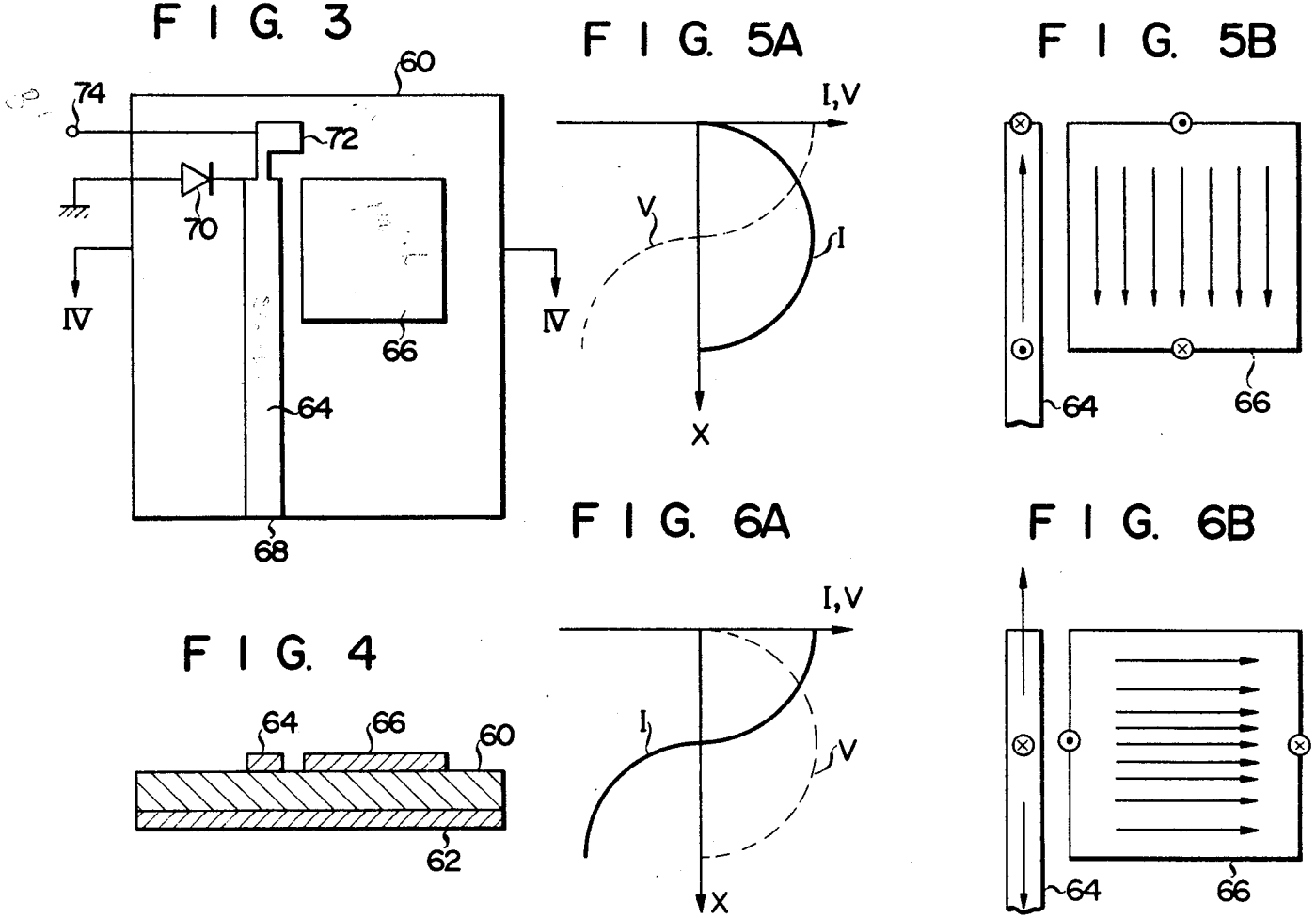
FIG. 3 indicates the arrangement of a linearly polarized strip antenna according to a first embodiment of this invention.
FIG. 4 is a cross sectional view of the first embodiment of the invention.
FIGS. 5A, 5B, 6A and 6B indicate the distribution of current and voltage, illustrating the operation of the first embodiment of the invention.

Description is now given with reference to the accompanying drawing of a strip antenna embodying this invention. FIG. 3 is a plan view of a linear polarization strip antenna according to a first embodiment of the invention. FIG. 4 is a cross sectional view on line IV—IV of FIG. 3. For convenience of description, the subject antenna is regarded as a transmission antenna. A conductive ground film 62 is mounted all over the backside of a dielectric substrate 60. The surface of the dielectric substrate 60 is fitted with a power supply strip line 64 formed of a conductive film and a linearly polarized wave-radiating element 66 also formed of a conductive film. Where the contraction of a wavelength by the dielectric substrate 60 is taken into account, let it be assumed that a radiated electromagnetic wave is chosen to have a wavelength $\lambda g$. Then the radiation element 66 is chosen to have a square form, each side of which measures $\lambda g/2$. The strip line 64 is set closely in parallel with one side of the square radiation element 66 to be electromagnetically coupled thereto. As viewed from FIG. 3, the upper end of the strip line 64 extends up to a point facing the upper left corner of the square radiation element 66. The lower end of the strip line 64 is connected as a power supply terminal 68 to a high frequency signal source (not shown). The upper end of the strip line 64 facing the upper left corner of the square radiation element 66 is connected to the cathode of a diode 70 as a switching element and also to a DC bias terminal 74 through a low pass filter 72. The anode of the diode 70 is grounded.

Description is now given with reference to FIG. 3 of the operation of a strip antenna according to the first embodiment of this invention. Where a negative voltage or ground potential is impressed on the bias terminal 74, then the diode is biased in the reverse direction to be cut off, causing the upper end of the strip line 64 to be opened. FIGS. 5A and 5B show the distribution of current and voltage in the strip line 64 and the manner in which the strip line 64 is electromagnetically coupled to the radiation element 66. Referring to FIG. 5A, the abscissa shows current I and voltage V, and the ordinate represents a distance X as measured from the upper end of the strip line 64. The solid line indicates current, and the broken line shown voltage.

FIG. 5B is a plan view of the strip line 64 and square radiation element 66. The arrows represent the distribution of current. The marks ⊙, ⊗ indicate the distribution of voltage. The distance X given in FIG. 5A is graduated in the same degree as the square radiation element 66 of FIG. 5B. Where the upper end of the strip line 64 is opened, current flowing through the strip line 64 reaches a maximum level at a point facing the center of that side of the square radiation element 66 which faces the strip line 64 and is reduced to zero at points facing the upper and lower left corners of the square radiation element 66. The voltage impressed on the strip line 64 is reduced to zero at a point facing the center of that side of the square radiation element 66 which faces the strip line 64. The voltages impressed at points facing both upper and lower left corners of the square radiation element 66 reach a maximum level, though having the opposite polarities. In this case, the electromagnetic coupling of the strip line 64 and the square radiation element 66 consists of inductive coupling by means of current.

Figure 7:
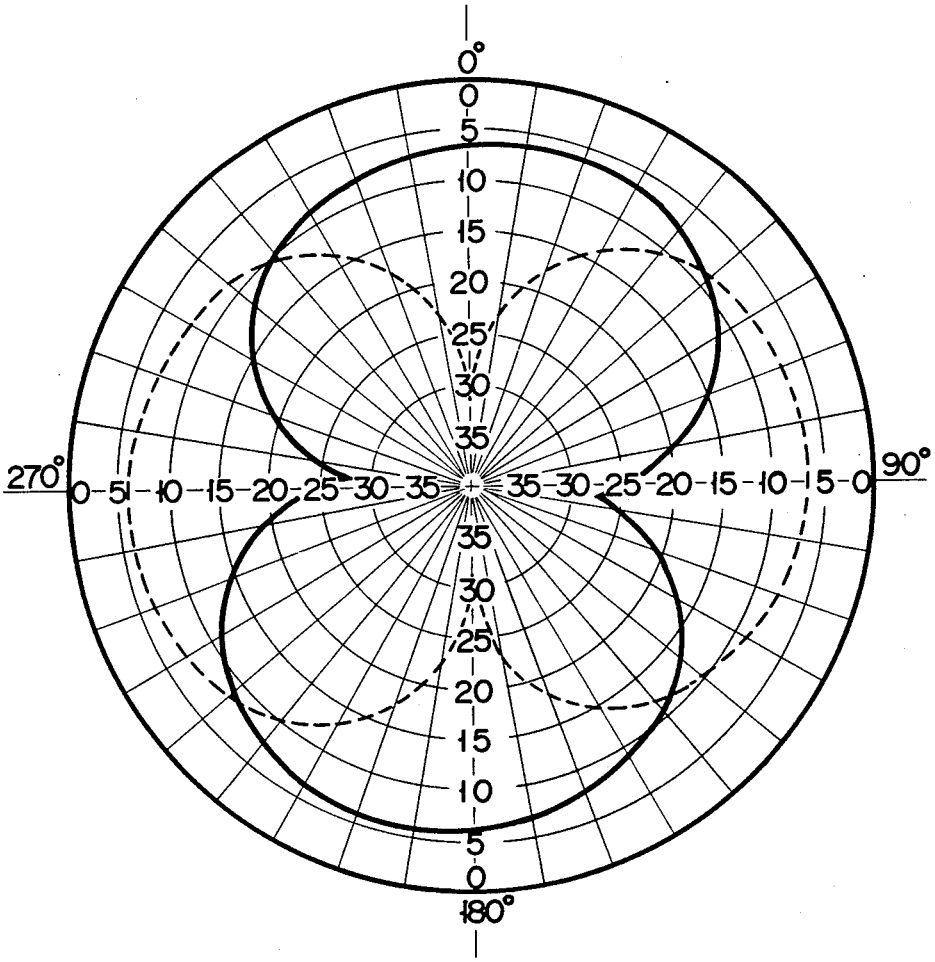
FIG. 7 sets forth a polarization pattern on the front side of the strip antenna of the first embodiment.

As seen from FIG. 5B, current flows on the surface of the square radiation element 66 in parallel with the strip line 64, giving rise to the induction of an electric field on those sides of the square radiation element 66 which intersect the path of current at right angles.

Where a positive voltage is impressed on the bias terminal 74, then the diode 70 is biased in the forward direction and rendered conductive. Therefore, the upper end of the strip line 64 is short-circuited. FIG. 6A indicates the distribution of current and voltage on the surface of the strip line 64. FIG. 6B shows the manner in which the strip line 64 and radiation element 66 are electromagnetically coupled together. FIGS. 6A and 6B respectively correspond to FIGS. 5A and 5B. Where the upper end of the strip line 64 is short-circuited, then current flowing through the strip line 64 is reduced to zero at a point corresponding to the center of that side of the square radiation element 66 which faces the strip line 64, reaches a maximum level at points facing left upper and lower corners of that side of the square radiation element 66, though with the opposite polarities, as shown in FIG. 6A. The voltage impressed on the strip line 64 reaches a maximum level at a point corresponding to the center of that side of the square radiation element 66 which faces the strip line 64, and is reduced to zero at points corresponding to the left upper and lower corners of that side of the square radiation element 66 which faces the strip line 64. Therefore, the electromagnetic coupling of the strip line 64 and square radiation element 66 consists of capacitive coupling based on an electric field. As seen from FIG. 6B, current flows on the surface of the square radiation element 66 in a direction intersecting the strip line 64 at right angles, giving rise to the induction of an electric field on those sides of the square radiation element 66 which intersect the current path at right angles. Where, therefore, the upper end of the strip line 64 is short-circuited, then the direction of linearly polarized is displaced 90° from that which is indicated in FIG. 5B when the strip line 64 is opened. FIG. 7 illustrates the polarization pattern appearing on the front side of a strip antenna according to a first embodiment of this invention. The solid curve represents a polarization pattern when the upper end (FIG. 3) of the strip line 64 is opened. The broken curves show a polarization pattern when the upper end is grounded.

The foregoing embodiment provides a linearly polarized strip antenna capable of changing the direction of polarization by simply comprising a linearly polarized radiation element, strip line electromagnetically coupled to the radiation element and switching element, for example, a diode for changing the condition of the upper end (FIG. 3) of the strip line 64 from the open to the short-circuited state or vice versa.

The strip antenna of this invention has the advantages that other components than the radiation element occupies smaller areas on the surface of a dielectric substrate, thereby enabling the strip antenna to be manufactured in a small size and at a reduced cost. Since the direction of polarization can be varied by only changing the manner in which the strip line and radiation element are electromagnetically coupled together, it is possible to eliminate the occurrence of errors in the phases of two power components in the division of a power by a divider. Therefore, the precision with which the direction of polarization is changed and the cross polarization discrimination is improved.

For convenience, the strip antenna is regarded as the transmission antenna in the foregoing description. However, the present invention is applicable to the receiving antenna exactly in the same way. The radiation element may have not only a square shape, but also a rectangular or circular shape, provided it can radiate linearly polarized waves. Where the radiation element has a circular shape, then part of the strip line is chosen to have an arcuate form matching the periphery of the radiation element. The arcuate portion of the strip line, namely, that part thereof which is electromagnetically coupled to the circular radiation element is chosen to have an electric length of $\lambda g/2$. Further, it is possible to extend the upper end (FIG. 3) of the strip line 64 beyond the left upper corner of the square radiation element 66, and attach a switching element, for example, a diode to the extended end portion of the strip line 64. It is also possible to connect a diode to the strip line through a stub. No particular limitation is imposed on the position of the diode. The point is that the diode should be so positioned that the distribution of current or voltage on the strip line has a maximum level at the center of the portion facing to one side of the radiation element and is reduced to zero at the both ends of that portion.

Figure 8:
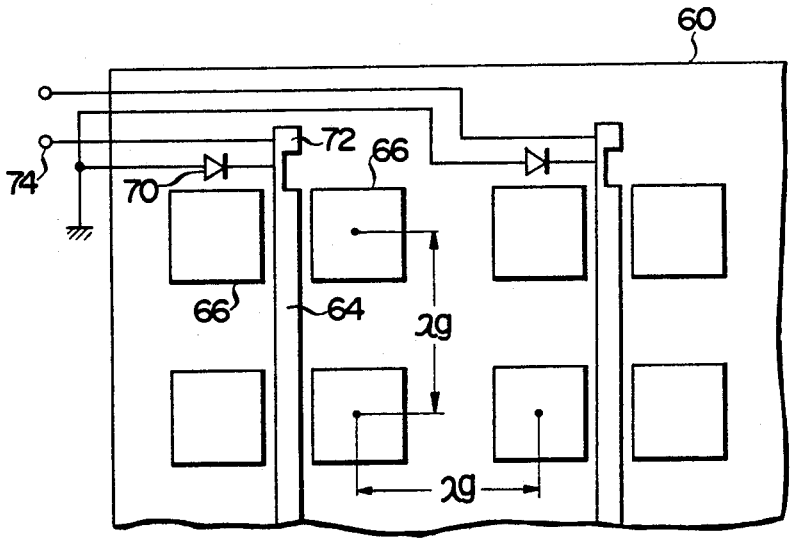
FIGS. 8 and 9 are the modifications of the first embodiment.
Figure 9:
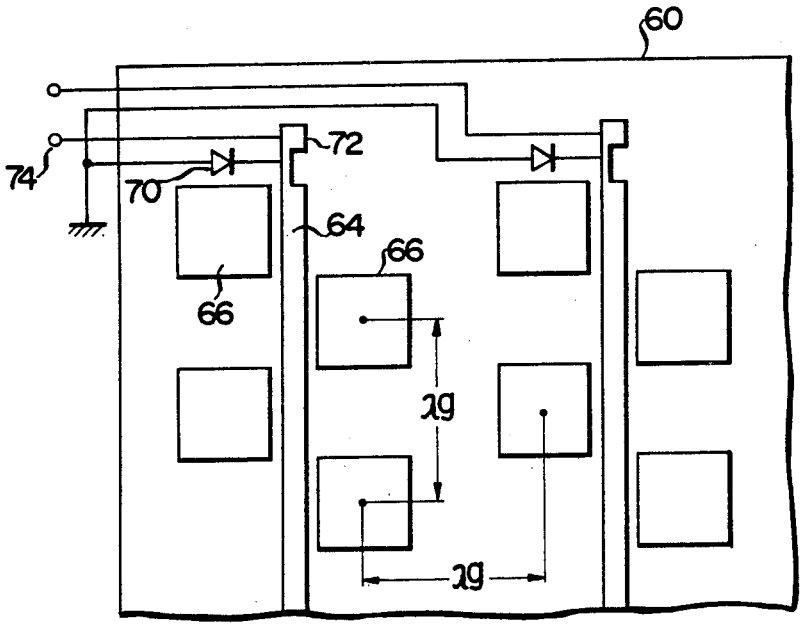
Figure 12B:
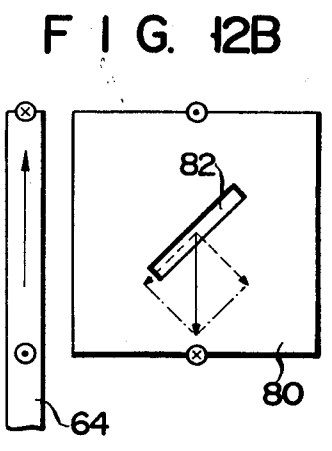
FIGS. 12A, 12B, 13A and 13B indicate the distributions of current and voltage, illustrating the operation of the second embodiment.
Figure 12A:
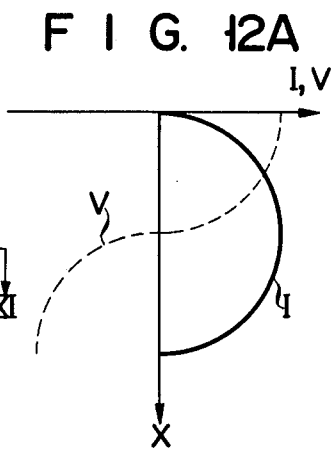

Description is now given with reference to FIGS. 8 and 9 of the modifications of the first embodiment of this invention, in which the subject strip antenna is applied as an array antenna. With the first embodiment of the invention, other components than the radiation element occupy small areas. Where, therefore, an array antenna is constructed, no limitation is imposed on the position of the radiation element, obtaining a desired array pattern. In this case, a distance between the adjacent radiation elements arranged along the strip line 64 and in a direction perpendicular to the strip line 64 is chosen to be equal to the length $\lambda g$ of the aforementioned radiated electromagnetic wave. As viewed from FIGS. 8 and 9, the upper end of each strip line 64 is fitted with a diode 70 and low pass filter 72. However, a single diode and single low pass filter can be used in common to the plural strip lines 64.

Figure 10:
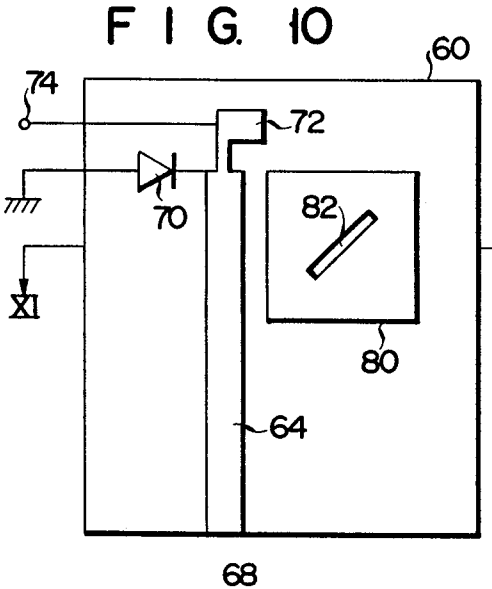
FIG. 10 shows the arrangement of a circularly polarized strip antenna according to a second embodiment of the invention.
Figure 11:
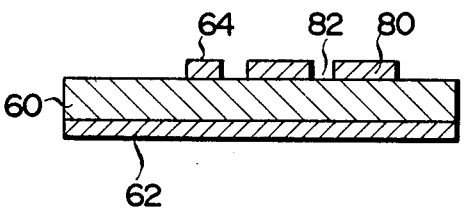
FIG. 11 is a cross sectional view of the second embodiment.

Description is now given with reference to FIGS. 10 and 11 of a strip antenna according to a second embodiment of this invention which can effect circular polarization. The parts of the second embodiment the same as those of the first embodiment are denoted by the same reference numerals, description thereof being omitted. FIG. 10 is a plan view of a strip antenna according to the second embodiment. FIG. 11 is a cross sectional view of the second embodiment. The second embodiment differs from the first embodiment in that an element 80 for radiating circularly polarized electromagnetic waves is provided. The radiation element 80 is made into a square shape, each side of which measures $\lambda g/2$. A slit 82 is formed along one of the diagonal lines of the radiation element 80.

Figure 13B:
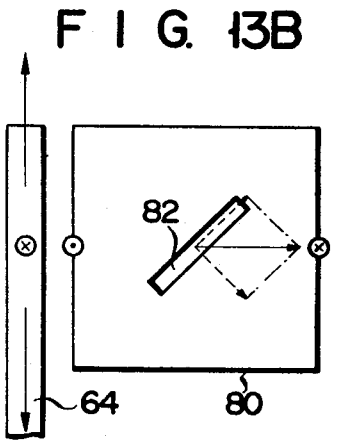
Figure 13A:
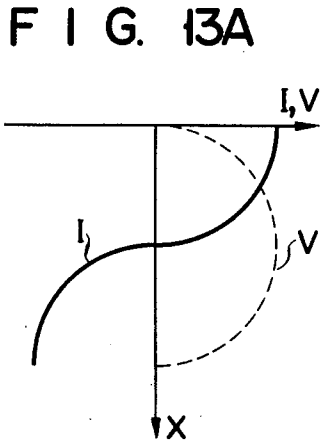

Description is now given of a strip antenna according to a second embodiment of this invention with reference to FIGS. 12A, 12B, 13A and 13B, which correspond to the previously described FIGS. 5A, 5B, 6A and 6B, respectively. Where the bias terminal 74 of the strip antenna is set at a negative or ground potential and the upper end (FIG. 10) of the strip line 64 is opened, then current flows on the radiation element 80 in parallel with the strip line 64 as indicated by a solid line arrow in FIG. 12B due to inductive coupling between the strip line 64 and radiation element 80. In this case, the slit 82 releases the degeneration of the mode of induced current. Therefore, the induced current is divided into a component parallel with the slit 82 and a component perpendicular to the slit 82 as indicated by broken lines in FIG. 12B. Both divided current components have an equal amplitude. The current component perpendicular to the slit 82 has a phase delayed 90° from that of the current component parallel with the slit 82. Therefore, as viewed from the conductive ground film 62, a right-hand circularly polarized wave is radiated.

Where the bias terminal 74 is set at a positive potential and the upper end (FIG. 10) of the strip line 64 is short-circuited, then current runs on the radiation element 80 in a direction perpendicular to the strip line 64 as indicated by a solid line arrow in FIG. 13B due to capacitive coupling between the strip line 64 and radiation element 80. This current is divided into a component parallel with the slit 82 and a component perpendicular to the slit 82 as indicated by broken lines in FIG. 13B. In this case, the component parallel with the slit 82 has a phase advanced 90° from the component perpendicular to the slit 82. Therefore, as viewed from the conductive ground film 62, a left-hand circularly polarized wave is radiated.

Figure 16:
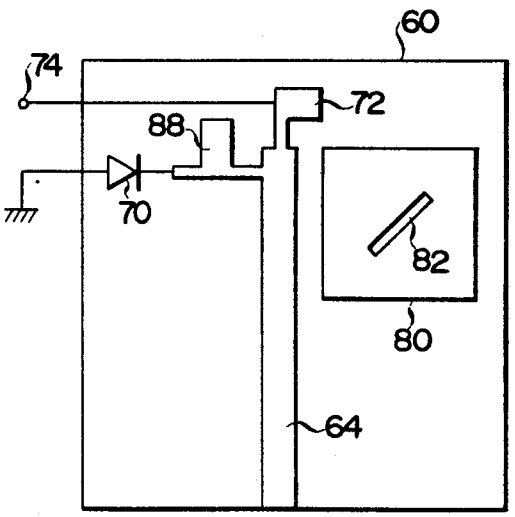
FIGS. 14, 15 and 16 show the modifications of the second embodiment.
Figure 15A:
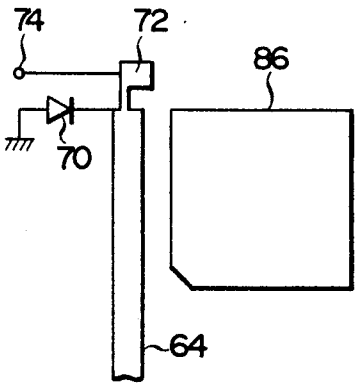
Figure 15B:
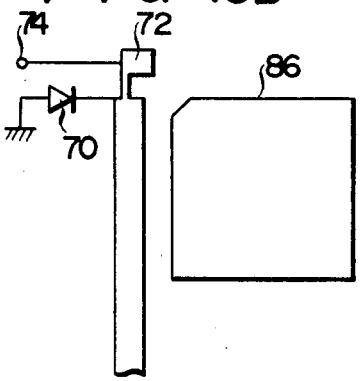
Figure 14A:
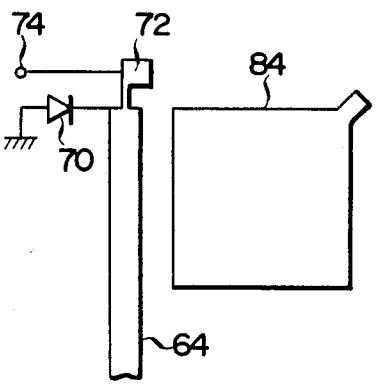
Figure 14B:
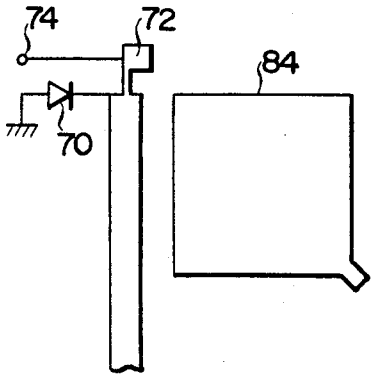

As described above, the second embodiment provides a circular polarization strip antenna of simple arrangement which can change the direction in which a polarized electromagnetic wave is circulated. With the second embodiment, it is possible to change the shape and other factors of a radiation element in various ways as in the first embodiment. For instance, the slit 82 may be formed along the opposite diagonal line to that of the radiation element 80 of FIG. 10. In this case, the circularly polarized electromagnetic wave is radiated in the opposite direction to that previously described. Further, it is possible to apply a substantially square radiation element 84, one corner of which is provided with a suitably shaped projection as shown in FIGS. 14A and 14B, or a substantially square radiation element 86, one of whose corners is cut off as seen from FIGS. 15A and 15B. Further, as shown in FIG. 16, an impedance matching circuit 88 may be connected between the upper end (FIG. 16) of the strip line 64 and diode 70. Obviously, the second embodiment may be applied as an array antenna as described in the first embodiment.

As mentioned above, this invention provides a compact strip antenna of very simple arrangement which can be constructed by electromagnetically coupling a strip line and radiation element and selectively changing the condition of the top end of the strip line from the open to the grounded state or vice versa, thereby accurately varying the direction of polarization.

What we claim is:

1. A strip antenna which comprises:

a dielectric substrate;

a strip line which is formed of a conductive film and on said dielectric substrate, and one of whose ends is used as a power supply terminal;

an antenna element which is formed of a conductive film, provided on said dielectric substrate in the proximity of the other end of the strip line, and is electromagnetically coupled to said strip line; and switching means connected to said other end of said strip line to selectively set said other end at an open or grounded state to change the distribution of current and voltage impressed on said strip line, thereby varying the mode in which said strip line is electromagnetically coupled to said antenna element.

2. A strip antenna according to claim 1, wherein said antenna element has a square shape, each side of which is chosen to have a length of $\lambda g/2$, when a radiated electromagnetic wave is set to have a wavelength of $\lambda g$ in consideration of the contraction by said dielectric substrate; the distribution of current on said strip line has a maximum level at the center of that portion facing one side of said antenna element and is reduced to zero at both ends of said portion, said antenna element and strip line are coupled by a magnetic field, and current is induced on said antenna element in a direction parallel with said strip line when said other end of said strip line is opened; the distribution of voltage on said strip line has a maximum level at the center of that portion facing one side of said antenna element and is reduced to zero at both ends of said portion, said antenna element and strip line are coupled by an electric field, and current is induced on said antenna element in a direction perpendicular to said strip line when said other end of said strip line is grounded.

3. A strip antenna according to claim 2, wherein said antenna element comprises a slit formed along one of the diagonal lines of said antenna element, and current induced on said antenna element is divided into one component running along said slit and another component which has a phase delayed 90° from that of said one component and runs perpendicular to said slit.

4. A strip antenna according to claim 1, 2 or 3, wherein said switching means comprises a diode whose cathode is connected to said other end of said strip line and whose anode is grounded and a DC bias terminal which is connected to the cathode of said diode through a low pass filter.

5. A strip antenna according to claim 4, wherein the cathode of said diode is connected to said other end of said strip line through an impedance matching circuit.

6. A strip antenna which comprises:

a dielectric substrate;

a plurality of strip lines which are each formed of a conductive film, parallel arranged on said dielectric substrate, and acts as power supply terminals at one end;

a plurality of antenna elements which are formed of a conductive film and on said dielectric substrate on both sides of said plurality of strip lines and electromagnetically coupled to said plurality of strip lines, the distance between the adjacent antenna elements being chosen to the wavelength of a radiated electromagnetic wave in consideration of the contraction by said dielectric substrate; and switching means connected to the other end of each of said plurality of strip lines selectively set said other end at an open or grounded state to change the distribution of current and voltage on said respective strip lines, thereby varying the mode in which said strip lines are electromagnetically coupled to said antenna elements.

7. A strip antenna according to claim 6, wherein said plurality of antenna elements have a square shape each side of which is chosen to have a length of $\lambda g/2$, when a radiated electromagnetic wave is set to have a wavelength of $\lambda g$ in consideration of the contraction by said dielectric substrate; the distribution of current on each of said plurality of strip lines has a maximum level at the center of a portion of said strip lines facing one side of said antenna elements and is reduced to zero at both ends of said portion, said antenna elements and strip lines are coupled by a magnetic field, and current is induced on said antenna elements in a direction parallel with said strip lines when said other end of said strip lines is opened; the distribution of voltage on each of said strip lines has a maximum level at the center of said portion and is reduced to zero at both ends of said portion, said antenna elements and strip lines are coupled by an electric field, and current is induced on said antenna elements in a direction perpendicular to said strip lines when said other end of said strip lines is grounded.

8. A strip antenna according to claim 7, wherein said plurality of antenna elements each comprises a slit formed along one of the diagonal lines of said antenna elements, and current induced on each of said antenna elements is divided into one component running along said slits and another component which has a phase delayed 90° from that of said one component and runs perpendicular to said slits.

9. A strip antenna according to claim 6, 7 or 8, wherein said switching means comprises a diode whose cathode is connected to said other end of said strip lines and whose anode is grounded and a DC bias terminal which is connected to the cathode of said diode through a low pass filter.

10. A strip antenna according to claim 9, wherein the cathode of said diode is connected to said other end of said strip lines through an impedance matching circuit.

* * * * *